US005188297A

United States Patent [19]

Asano

[11] Patent Number: 5,188,297

[45] Date of Patent: Feb. 23, 1993

[54] PRESSURE TIGHT INJECTOR

[75] Inventor: Hitoshi Asano, Obu, Japan

[73] Assignee: Aisan Kogyo Kabushiki Kaisha, Obu, Japan

[21] Appl. No.: 835,407

[22] Filed: Feb. 14, 1992

[30] Foreign Application Priority Data

Feb. 28, 1991 [JP] Japan ..... 3-017656[U]

[51] Int. Cl.[5] ..... F02M 51/06

[52] U.S. Cl. ..... 239/585.3; 239/585.1; 239/DIG. 4

[58] Field of Search ..... 239/585.1, 585.3, 585.4, 239/DIG. 4; 251/129.21

[56] References Cited

U.S. PATENT DOCUMENTS

| | | | |
|---|---|---|---|
| 3,462,116 | 8/1969 | Wright, Jr. | 251/129.21 |
| 4,385,339 | 5/1983 | Takada et al. | 251/129.21 X |
| 4,863,143 | 9/1989 | Cowley et al. | 239/585.4 X |
| 4,917,352 | 4/1990 | Havet et al. | 239/585.3 X |
| 4,967,966 | 11/1990 | Babitzka et al. | 239/585.4 |

*Primary Examiner*—Andres Kashnikow
*Assistant Examiner*—William Grant
*Attorney, Agent, or Firm*—Dennison, Meserole, Pollack & Scheiner

[57] ABSTRACT

An injector includes a casing having a through-hole extending along the axis thereof from a front end surface thereof to a rear end surface thereof; a valve housing inserted in the through-hole through the front end surface and adapted for slidably guiding a valve; a fuel pipe inserted in the through-hole through the rear end surface; and a solenoid coil disposed in a space defined between the outer peripheral surface of the fuel pipe and the inner peripheral surface of the casing. The through-hole of the casing includes an enlarged-diameter portion opening to the rear end surface, an intermediate-diameter portion provided in front of the enlarged-diameter portion and a reduced-diameter portion provided in front of the intermediate-diameter portion. The fuel pipe is inserted at least to a position where it reaches the intermediate-diameter portion, a cylindrical block being fitted on a portion of the fuel pipe to be inserted in the casing. A sealing ring is disposed in a compressed manner in an annular space defined by a rear end surface of the reduced-diameter portion, an inner peripheral surface of the intermediate-diameter portion, a front end surface of the cylindrical block and an outer peripheral surface of the fuel pipe. The inside of the reduced-diameter portion is separated from the inside of the enlarged-diameter portion so as to prevent leakage of fuel.

7 Claims, 2 Drawing Sheets

PRESSURE TIGHT INJECTOR

BACKGROUND OF THE INVENTION

1. Field of the Invention

The present invention relates to an injector to be used in a fuel injection system for an internal combustion engine, and more particularly to such an injector to which highly pressurized fuel is supplied.

2. Description of the Prior Art

A conventional injector most similar to the present invention has a construction as shown in FIG. 2.

In FIG. 2, the injector includes a casing 2 having a through-hole 2c extending along the axis thereof from a front end surface 2a to a rear end surface 2b. A valve housing 5 is fixedly inserted in the through-hole 2c through the front end surface 2a. A valve 7 is slidably received within the valve housing 5. A fuel pipe 9 is fixedly inserted in the through-hole 2c through the rear end surface 2b. A solenoid coil 10 is disposed in a space defined between an outer peripheral surface of the fuel pipe 9 and an inner peripheral surface of the casing 2. An armature 8 is fixedly mounted to a rear end of the valve 7. A pipe member 14 is fixedly disposed in the fuel pipe 9. A spring 15 is interposed between the pipe member 14 and the armature 8 in a compressed manner so as to forwardly bias the valve 7. While the valve 7 is at its advanced position, the valve 7 closes an injection hole 5a formed at a front end of the valve housing 5. When the solenoid coil 10 is energized, the valve 7 is rearwardly attracted through the armature 8 to open the injection hole 5a. The solenoid coil 10 is wound around a bobbin 11.

The injector constructed as described above is supplied with pressurized fuel through a hose 3. In order to prevent leakage of the pressurized fuel to the solenoid coil 10, a first O-ring 12 is provided between a front end of the bobbin 11 and the casing 2 and a second O-ring 13 is provided between a rear end of the bobbin 11 and the fuel pipe 9.

In such a structure, however, pressure of the pressurized fuel acts on the bobbin 11. So long as the pressure of the pressurized fuel is in the order of 2 to 5 kgf/cm2 used in most of the recent fuel injection systems, such a structure will cause no problem. However, when the fuel pressure rises to the order of, for example, 100 kgf/cm2, the bobbin 11 of the structure cannot bear the pressure. More specifically, there is a possibility of deformation or breakage of the bobbin 11.

SUMMARY OF THE INVENTION

It is an object of the present invention to provide an injector having an improved pressure tight property.

It is another object of the present invention to improve sealing property by reducing the number of portions requiring fluid-tight sealing.

In order to achieve the above and other objects, there is provided an injector including a casing having a through-hole extending along the axis thereof from a front end surface thereof to a rear end surface thereof; a valve housing inserted in the through-hole through the front end surface and adapted for slidably guiding a valve; a fuel pipe inserted in the through-hole through the rear end surface; and a solenoid coil disposed in a space defined between the outer peripheral surface of the fuel pipe and the inner peripheral surface of the casing. The through-hole of the casing includes an enlarged-diameter portion opening to the rear end surface, an intermediate-diameter portion provided in front of the enlarged-diameter portion and a reduced-diameter portion provided in front of the intermediate-diameter portion. The fuel pipe is inserted at least to a position where it reaches the intermediate-diameter portion, a cylindrical block being fitted on a portion of the fuel pipe to be inserted in the casing. A sealing ring is disposed in a compressed manner in an annular space defined by a rear end surface of the reduced-diameter portion, an inner peripheral surface of the intermediate-diameter portion, a front end surface of the cylindrical block and an outer peripheral surface of the fuel pipe. The inside of the reduced-diameter portion is separated from the inside of the enlarged-diameter portion so as to prevent leakage of fuel.

The invention will be more fully understood from the following detailed description and appended claims when taken with the drawings.

DETAILED DESCRIPTION OF THE PREFERRED EMBODIMENT

Figure 1:
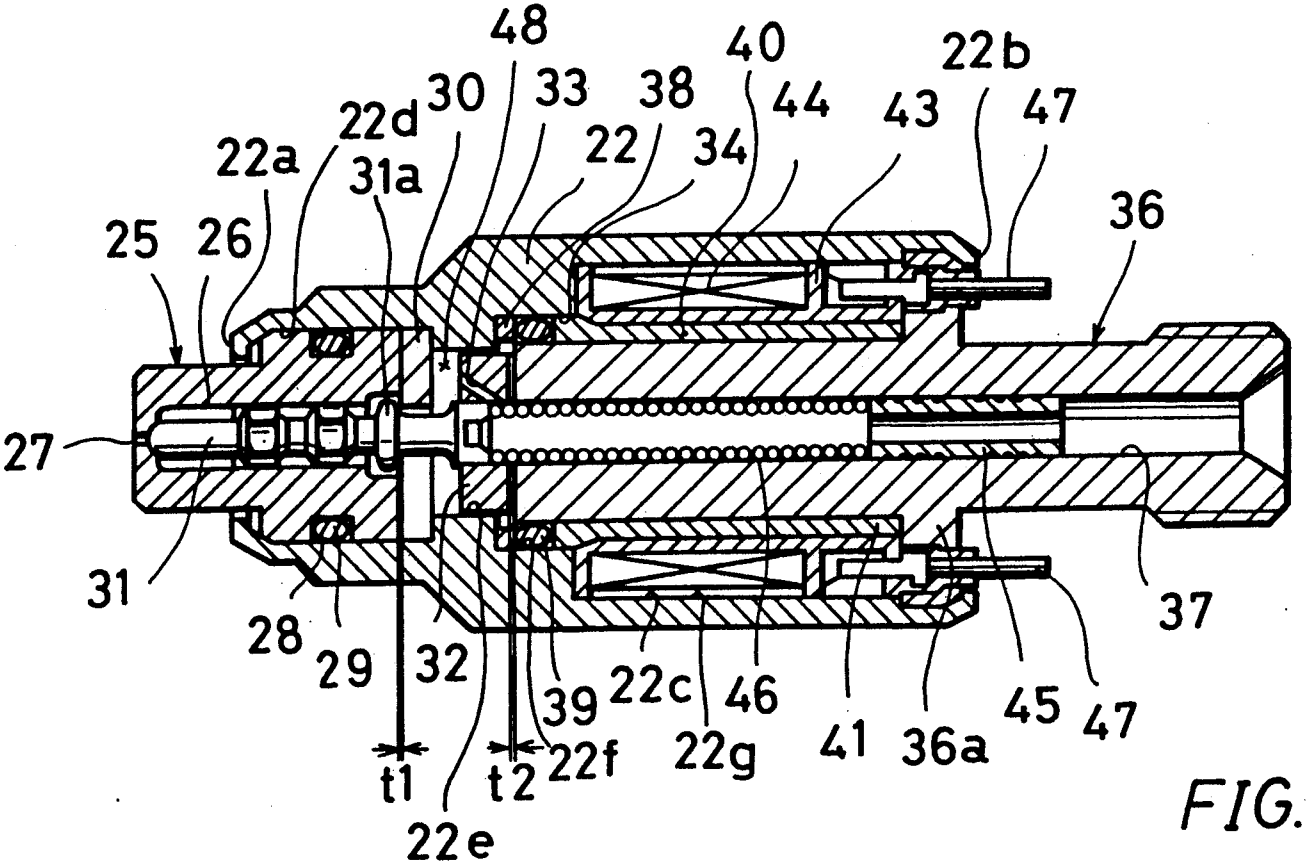
FIG. 1 is a vertical sectional view of a preferred embodiment of the injector according to the present invention.
Figure 2:
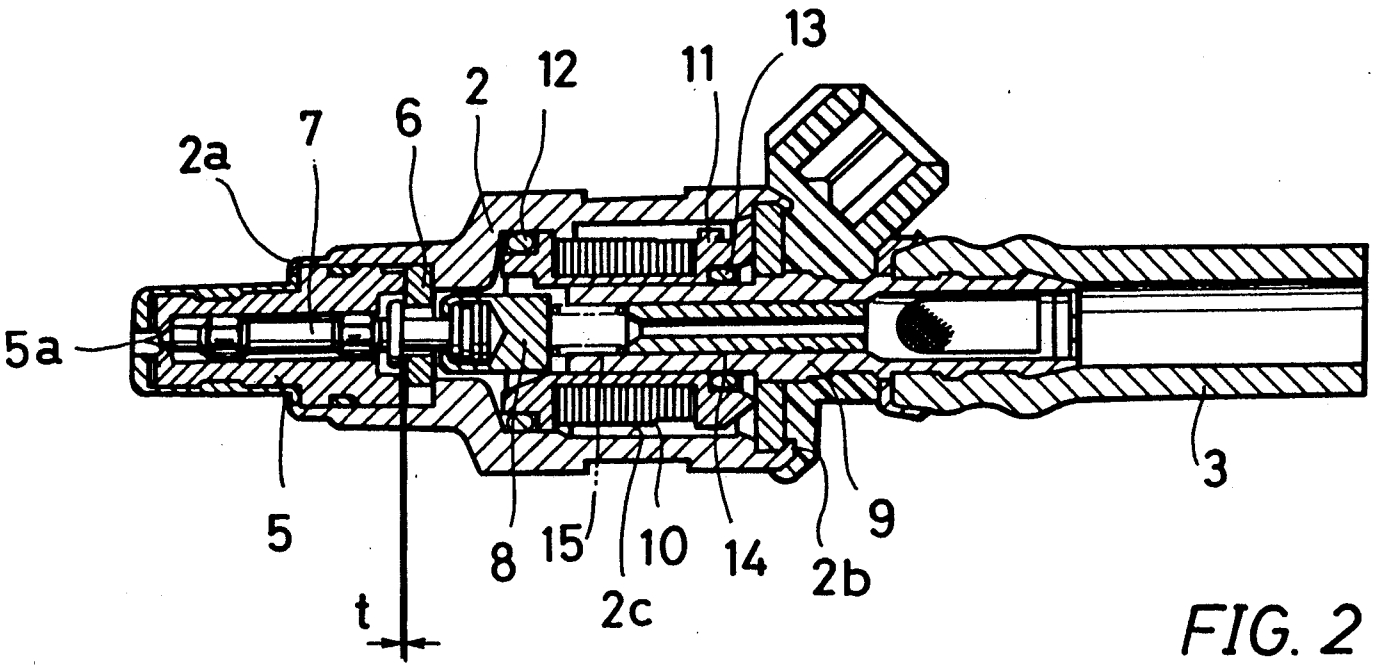
FIG. 2 PRIOR ART
FIG. 2 is a vertical sectional view of the injector in the prior art.

FIG. 1 shows an embodiment of the injector according to the present invention, which includes a casing 22 having a through-hole 22c extending from a front end surface 22a to a rear end surface 22b. The through-hole 22c has an enlarged-diameter portion 22g opening to the rear end surface 22b, an intermediate-diameter portion 22f provided in front of the enlarged-diameter portion 22g, a reduced-diameter portion 22e provided in front of the intermediate-diameter portion 22f, and a mounting hole 22d for a valve housing 25 defined in the foremost position.

The valve housing 25 has in the axial central portion thereof a guide hole 26 in which a valve 31 is slidably guided. The valve body 25 has at a front end surface thereof an injection hole 27. An armature 32 is fixedly mounted to a rear end of the valve 31. There is provided a horseshoe type stopper 30. The valve housing 25 is installed, with the valve 31 received therein and the stopper 30 interposed between the valve housing 25 and the casing 22. The valve housing 25 has a peripheral groove 28 in which a sealing O-ring 29 is received in a compressed manner. The O-ring 29 is adapted to prevent fuel from leaking out through a gap between the casing 22 and the valve housing 25. The valve 31 is formed with a flange 31a which is adapted to limit rearward movement of the valve 31. When the valve 31 is at its advanced position, there is a clearance t1 between the flange 31a and the stopper 30. The armature 32 is formed with a fuel passage 33. The armature 32 is slidably guided within the reduced-diameter portion 22e.

A fuel pipe 36 is inserted in the through-hole through the rear end surface 22b of the casing 22. The fuel pipe 36 is formed with a flange 36a at a position corresponding to the rear end surface 22b of the casing 22 when inserted therein.

As shown in FIG. 1, the fuel pipe 36 is inserted from the rear end surface 22b to a position where it reaches the intermediate-diameter portion 22f. A cylindrical block 40 is fitted on a portion of the fuel pipe 36 which is to be inserted in the casing 22.

A rear end surface of the reduced-diameter portion 22*e* of the casing, an inner peripheral surface of the intermediate-diameter portion 22*f*, a front end surface of the cylindrical block 40 and an outer peripheral surface of the fuel pipe 36 cooperate to define an annular space, in which a sealing O-ring 39 is received in a compressed manner. A ring member 38 is interposed between the rear end surface of the reduced-diameter portion 22*e* and the O-ring 39. The O-ring 39 serves to prevent leakage of fuel in the inside 48 of the reduced-diameter portion 22*e* to the inside space of the enlarged-diameter portion 22*g*.

When the valve 31 is at its advanced position, there is a clearance t2 between a rear end surface of the armature 32 and a front end surface of the fuel pipe 36 which is slightly greater than the clearance between the flange 31*a* and the stopper 30.

A solenoid coil 44 is wound around the bobbin 43 in a space defined between an inner peripheral surface of the enlarged-diameter portion and an outer peripheral surface of the cylindrical block 40. There is provided a connecting terminal 47 for the solenoid coil 44. The cylindrical block 40 has a rear end 41 in abutment against the flange 36*a* of the fuel pipe 36.

The fuel pipe 36, having the cylindrical block 40 fitted thereon, with the bobbin 43 around which the coil 44 is wound fitted on the cylindrical block 40, and the O-ring 39 fitted on the front end portion of the fuel pipe 36, is inserted into the through-hole 22*c* through the enlarged-diameter portion 22*g*. After insertion, the rear end of the casing 22 is crimped as shown by 22*h* to fix the fuel pipe 36 therein.

The fuel pipe 36 has a through-hole 37 in which a pipe member 45 and a spring 46 are inserted from rearwardly thereof, and after the pipe member 45 is positioned so as to adjust the spring force, the fuel pipe 36 is staked to the pipe member 45 so as to fix the pipe member 45.

The fuel pipe 36, the armature 32 and the casing 22 are made of a magnetic material so as to form a magnetic path around the solenoid coil 44. The ring member 38 and the cylindrical block 40 are made of a nonmagnetic material so as to reduce leaked magnetic flux.

In the arrangement as described above, the O-ring 39 separates the inside space 48 of the reduced-diameter portion 22*e* from the inside of the enlarged-diameter portion 22*g* so as to prevent leakage of fuel. Thus, the bobbin 43 is not subject to the fuel pressure.

Therefore, even if highly pressurized fuel is supplied through the through-hole 37 of the fuel pipe 36, the bobbin 43 and the solenoid coil 44 are free from the effect of the fuel pressure, providing a remarkably improved pressure tight property. Furthermore, as the bobbin 43 is not required to be of high strength, it can be formed of any desired configuration so as to improve the characteristic of the magnetic path of the coil 44.

What is claimed is:

1. An injector including:

a casing having a through-hole extending along the axis thereof from a front end surface thereof to a rear end surface thereof;

a valve housing inserted in said through-hole through the front end surface and adapted for slidably guiding a valve;

a fuel pipe inserted in said through-hole through the rear end surface; and a solenoid coil disposed in a space defined between the outer peripheral surface of the fuel pipe and the inner peripheral surface of the casing; said injector characterized in:

said through-hole of said casing including an enlarged-diameter portion opening to said rear end surface, an intermediate-diameter portion provided in front of said enlarged-diameter portion and a reduced-diameter portion provided in front of said intermediate-diameter portion;

said fuel pipe being inserted at least to a position where it reaches said intermediate-diameter portion, a cylindrical block being fitted on a portion of said fuel pipe to be inserted in said casing;

a sealing ring being disposed in a compressed manner in an annular space defined by a rear end surface of said reduced-diameter portion, an inner peripheral surface of said intermediate-diameter portion, a front end surface of said cylindrical block and an outer peripheral surface of said fuel pipe; and the inside of said reduced-diameter portion being separated from the inside of said enlarged-diameter portion so as to prevent leakage of fuel.

2. The injector as defined in claim 1, wherein a ring member is interposed between the rear end surface of said reduced-diameter portion and the sealing ring.

3. The injector as defined in claim 2, wherein said ring member is made of a nonmagnetic material.

4. The injector as defined in claim 1, wherein the fuel pipe is formed with a flange at a position corresponding to the rear end surface of said casing, a rear end of said cylindrical block being in abutment against a front end of said flange.

5. The injector as defined in claim 1, wherein said cylindrical block is made of a nonmagnetic material.

6. The injector as defined in claim 1, wherein an armature is slidably received within said reduced-diameter portion.

7. The injector as defined in claim 1, wherein said solenoid coil is disposed in a space defined between an outer peripheral surface of said cylindrical block and an inner peripheral surface of said enlarged-diameter portion.

* * * * *